United States Patent [19]

Gulbenkian

[11] Patent Number: 4,884,918

[45] Date of Patent: Dec. 5, 1989

[54] METHOD AND APPARATUS FOR CELLULAR CONSTRUCTION STRUCTURE

[76] Inventor: Paul Gulbenkian, P.O. Box 42105, San Francisco, Calif. 94142

[21] Appl. No.: 68,272

[22] Filed: Jun. 29, 1987

Related U.S. Application Data

[63] Continuation of Ser. No. 732,360, May 8, 1985, abandoned.

[51] Int. Cl.[4] ..... E02B 17/00

[52] U.S. Cl. ..... 405/202; 114/266; 405/195; 405/210; 405/211

[58] Field of Search ..... 405/23, 26, 195, 202, 405/203, 205, 210, 211; 114/264, 266

[56] References Cited

U.S. PATENT DOCUMENTS

| | | | |
|---|---|---|---|
| 1,908,714 | 5/1933 | Schneider | 114/65 A |
| 3,225,499 | 12/1965 | Kourkene | 52/744 |
| 3,793,842 | 2/1974 | Lacroix | 405/205 |
| 4,067,285 | 1/1978 | Jones et al. | 114/266 |
| 4,118,941 | 10/1978 | Bruce et al. | 405/211 |
| 4,363,567 | 12/1982 | Van der Graaf | 405/202 |

FOREIGN PATENT DOCUMENTS

| | | | |
|---|---|---|---|
| 1514461 | 5/1975 | United Kingdom | 405/26 |

*Primary Examiner*—David H. Corbin

*Attorney, Agent, or Firm*—Limbach, Limbach & Sutton

[57] ABSTRACT

An improved method and apparatus for structures comprising a plurality of substantially identical structural cells, each comprising a cube having concrete walls of selected or calculated thickness. The walls enclose a hollow interior so that each cube is floatable. The walls are constructed so that tendons can be passed inside the walls in orthogonal directions. The tendons are tensioned after the structure has been assembled so as to prestress all walls along at least two dimensions so as to provide a three dimensional posttensioning effect on the concrete in the structure. Means are also provided which communicate with each of the cells for selectively filling or emptying each cell with liquid. The cells can be joined together at a drydock on land or at sea to form the structure.

13 Claims, 6 Drawing Sheets

METHOD AND APPARATUS FOR CELLULAR CONSTRUCTION STRUCTURE

This is a continuation of application Ser. No. 732,360, filed May 8, 1985 now abandoned.

TECHNICAL FIELD

The present invention relates to a method and apparatus for constructing structures, and more particularly to a method and apparatus for utilizing substantially identical structural cells and interconnecting the same to form resilient structures of changeable buoyancy.

BACKGROUND ART

In the past, structures for use on or in bodies of water have typically been cast in place on dry land, and then floated to the resident site and then sunk into position. Typical of these structures is that shown in the booklet published by the Prescon Corporation of San Antonio, Tex. and entitled Freyssinet Offshore, 1976. This reference discloses a number of offshore drilling platforms which are constructed of prestressed, cast in place arrays of columns which are surrounded by a perforated breakwater wall.

A significant disadvantage of such a structure is the requirement that the structure be cast in place and floated as a whole to the eventual resting site. Further, the overall shape of the platform requires complex configurations of posttensioning tendons. The large size of the finished platform presents a multitude of logistical problems in transporting the platform to its eventual resting site. Further, because such platforms are essentially a single structure, they are typically custom designed for the particular site. Finally, the customized nature of each of these platforms tends to maintain the cost of the platforms at a high level.

In known platforms with or without undersea storage tanks, such platforms are built of steel or posttensioned prestressed concrete. In such structures the tendons are primarily circular or curvilinear and of medium size. The tendons are forced, by the circumvolutions of the concrete, into many lengths and diameters and complicated intersections.

SUMMARY OF THE INVENTION

These and other problems and disadvantages of previous waterborn structures are overcome by the present invention of a method and apparatus comprising a structure which includes a plurality of substantially identical structural cells, each comprising a parallelepiped, such as a cube having concrete walls of a specified thickness which enclose a hollow interior. As such, each cube is floatable in water when the interior is filled with air. In the structure, a plurality of walls of each cube are juxtaposed into registration with the walls of adjacent cubes. Means are provided for maintaining the juxtaposed walls in contact with each other. Means are also provided which communicate with each cube for controllably filling liquid into or evacuating liquid from the cubes so as to modify the buoyancy of the concrete structure.

In a preferred embodiment of the present invention each of the walls of the cube are constructed so as to accommodate posttensioning tendons therethrough so that appropriate posttensioning tendons can be extended through each of the walls of the cubes which are positioned in common planes, said tendons being placed under tension to posttension each of the walls of each cube in at least two dimensions. A three-dimensional posttensioning is thus provided by this structure.

Structures constructed out of these structural cells and with multidimensional posttensioning by way of tendons passing inside and through the cell walls provide a resilient structure of high strength. A feature and advantage of the invention is its lower first cost. Another advantage is zero or low maintenance of the tendons if the tendons are oil filled. Further, there is excellent response of the structure to forces supplied by the elements or seismic loads. It is to be understood that the present invention permits the building of structures from standard cells which cells permit the application of three-dimensional posttensioning to the structure.

The present invention provides hollow parallelepiped-like elements, such as cubes, that can be safely connected together in any medium, to construct a myriad of differently shaped megastructures. In addition, such structures can be added to or subtracted from to provide overall structures of different sizes and shapes.

It is therefore an object of the present invention to provide a method and apparatus for constructing structures of substantially identical structural cells.

It is another object of the present invention to provide a method and apparatus for constructing structures of substantially identical structural cells wherein the structural cells are posttensioned against one another through common tendons which extend within the walls of each of the structural cells.

It is another object of the present invention to provide a method and apparatus for constructing a structure which can be easily expanded or reduced in size by the addition or subtraction of substantially identical structural cells.

It is a further object of the present invention to provide a method and apparatus for constructing a structure of identical structural cells which are posttensioned against one another so as to provide a resilient structure of high strength.

These and other objectives, features and advantages of the present invention will be more readily understood upon consideration of the following detailed description of the invention taken with the accompanying drawings.

DETAILED DESCRIPTION OF THE INVENTION

In accordance with the present invention, substantially identical structural cells are coupled to one another to form larger structures. These structural cells are rhombic or parallelepipedic elements. These include right-angled parallelepipeds, namely parallelepipeds which have right-angled corners, such as cubes. Preferably these elements are cubic and have walls which enclose a hollow interior. Preferably the cubes are constructed of concrete and are 60 feet on a side. The walls of the cubes are of uniform thickness and preferably 4 feet thick. A cube of this structure will float even in fresh water. It is to be understood that hollow concrete elements of dimensions proportional to those discussed above will also satisfy the requirements of the present invention.

Figure 1:
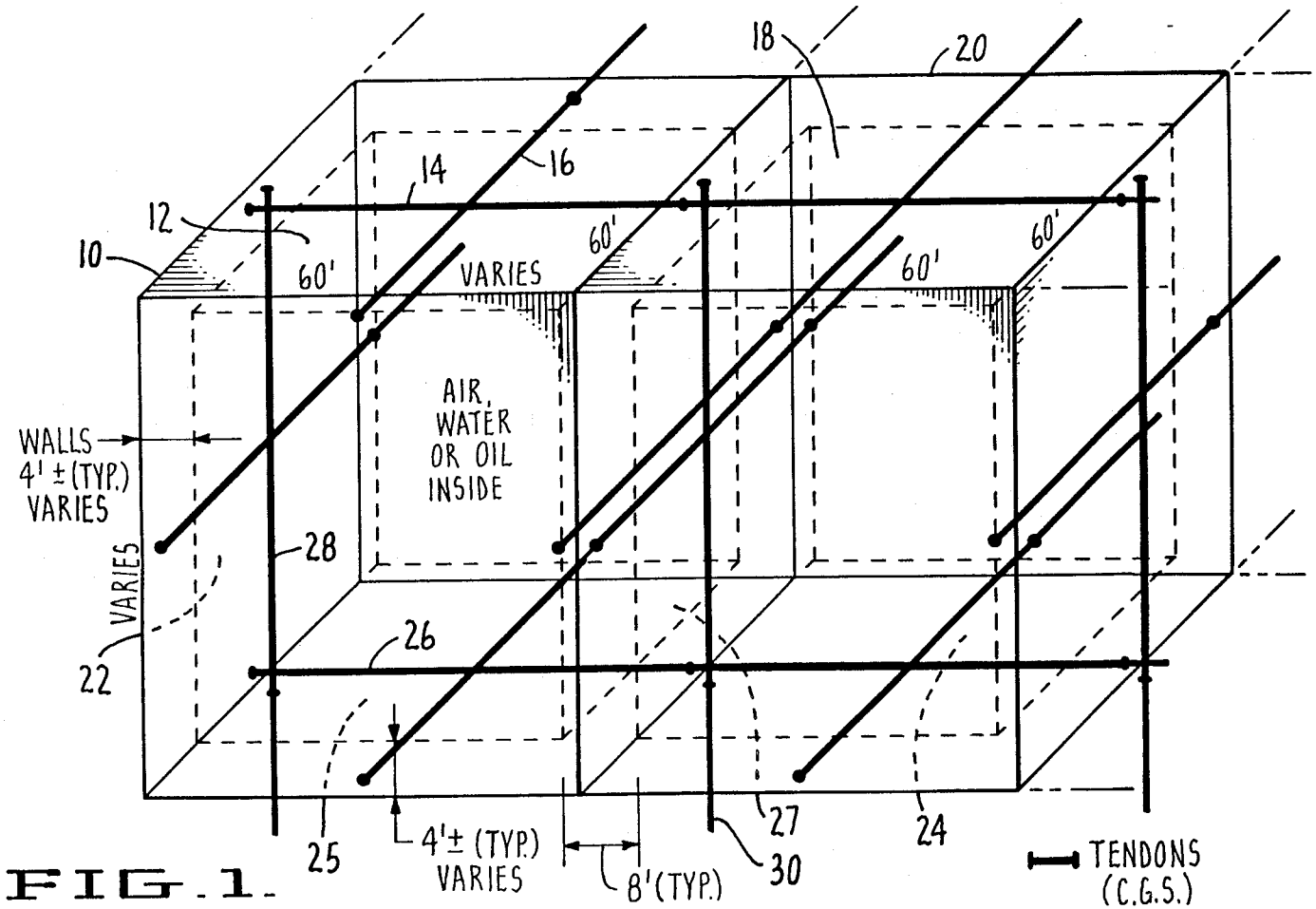
FIG. 1 illustrates two structural cells in accordance with the present invention.

The cubes or elements are connected together by tendons inserted into tubing or threaded oil pipes, of the type used for oil drilling, which tubing or pipe extend within the walls of the cubes. Referring to FIG. 1, two cubes are shown juxtaposed to one another in accordance with the present invention. The solid lines in the figures represent the external edges of the cube, while the dotted lines illustrate the hollow portion of each cube. In order to simplify the description, only a single tendon is shown extending through a particular wall for a particular dimension, it being understood that in practice a multiplicity of tendons will extend through each of the walls of a cube for each dimension of the wall.

Thus, for cube 10, and upper wall 12, tendon 14 extends through wall 12 along one dimension of the wall, while tendon 16 extends through wall 12 in an orthogonal dimension of the wall. Note that tendon 14 also extends through upper wall 18 of cube 20.

Likewise, for bottom wall 25 of cube 10 and bottom wall 24 of cube 20 tendon 26 extends therethrough along one dimension. For side wall 22 of cube 10 tendon 28 extends therethrough in an orthogonal direction. Similarly, with respect to side wall 27, tendon 30 extends therethrough in an orthogonal direction to that of tendon 26.

It is to be understood that, in practice, each of the walls of a structural cell will have tendons extending therethrough in two orthogonal dimensions. While such a structure requires a large number of cables, for any particular structure the number of different lengths and size of cables requires will be limited. Further, the tendons extend along straight lines as opposed to curves. This makes the tensioning and securing of the tendons much simpler than in previous designs.

As can be seen from FIG. 1, tendons 14 and 16 posttension those walls which lie in a common plane. Further, tendon 28 and the unlabelled tendon, both of which extend through wall 22, posttension walls in a common plane which is different from the common plane to which tendons 14 and 16 are parallel. Further, it can be seen that the posttensioning of these various common planes provides a posttensioning of the structure in three dimensions.

In the preferred embodiment of the present invention concrete is the material from which the walls of each structural cell is constructed. Concrete has excellent strength under compression. When prestressed, concrete also provides excellent bending characteristics. Preferably, steel is utilized in the tendon to take advantage of its favorable tensile strength.

Tendons suitable for use in the present invention are of the type described in U.S. Pat. No. 3,225,499. The structure shown therein permits anchor plates to be installed after the tendons have been placed in the structure or after the concrete is cured. Preferably, the tendons are not bonded with cement grout, but enveloped and coated with oil or grease. This permits the tendons to be removed for inspection in the future.

Hollowness gives lightness and flexibility to the structural cells. Prestressing gives flexibility to the concrete of the cells. The cells should be smooth and leveled at their surface of contact with other cells. In the preferred embodiment of the present invention, in addition to the joining of the cells by the posttensioning tendons, the outer periphery of each wall surface is bonded to the adjoining wall surface periphery. Preferably the width of this perimeter is 4 feet.

The tendons are disposed inside the walls of the cells in both directions and uniformly. The tendons are preferably arranged in the middle of the width dimension of the 4 foot thick walls and extend straight through the walls. In the same wall, they are also at 90° from one another. The cross each other by being displaced, preferably, one-half cable diameter on each side of the C.G.C., i.e. center of gravity of concrete, of the concrete slab or wall. A number of cells are connected together by threading the tendons into and through their preassigned holes. The tubes can be tubing or pipe steel.

By providing posttensioning tendons in each of the walls of each cell, a posttensioning in three dimensions can be achieved.

Figure 2:
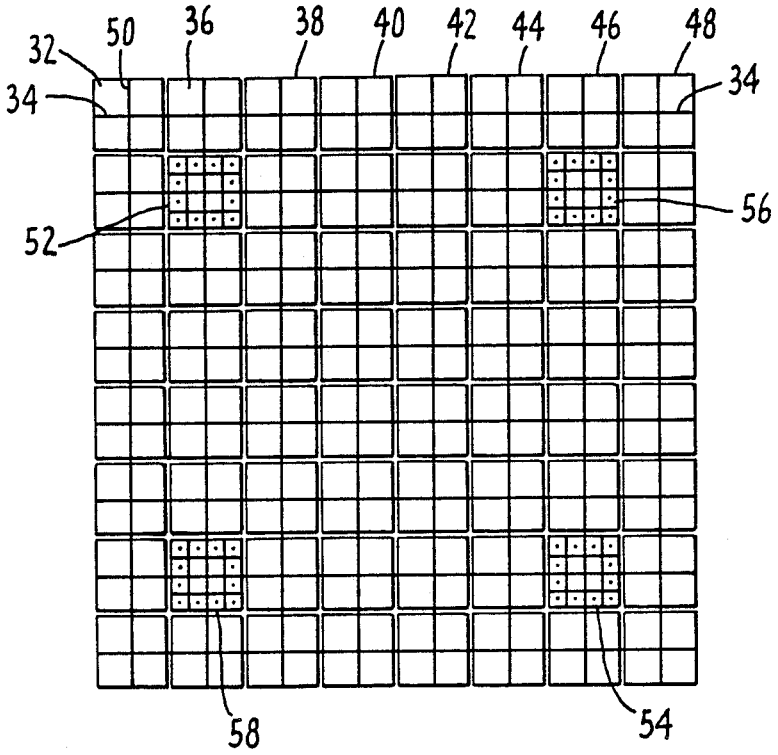
FIG. 2 illustrates a horizontal cross-sectional view of an undersea tank constructed in accordance with the present invention.

FIG. 2 illustrates a plan section of an undersea tank constructed in accordance with the present invention. The double solid lines represent the junction between structural cells, while the single solid lines represent the tendons extending through the walls of the cells. Thus, the tank of FIG. 2 is preferably constructed to have eight structural cells along each dimension of the tank. For example, a structural cell 32 occupies the upper left-hand corner of the plan view of the second shown in FIG. 2. Tendon 34 passes through the upper walls of cells 32, 36, 38, 40, 42, 44, 46 and 48. The other tendon which passes in an orthogonal direction through the upper wall of cell 32 is tendon 50. This tendon extends through the upper wall of the cells lying along the left-hand edge of the horizontal plan section shown in FIG. 2.

Steel piers, piping, or drilling conductors are provided in the position of the structural cells located towards the corners of the platform. For example, steel piers 52 and 54 provide space for drilling conductors to extend through the storage tank down into the floor of the body of water. Steel piers 56 and 58 can provide passageways for piping which access the different levels of the storage tank.

While not specifically shown in FIG. 2, it is to be understood that posttensioning is provided in the walls of each cell in the vertical dimension of the storage tank.

Figure 3:
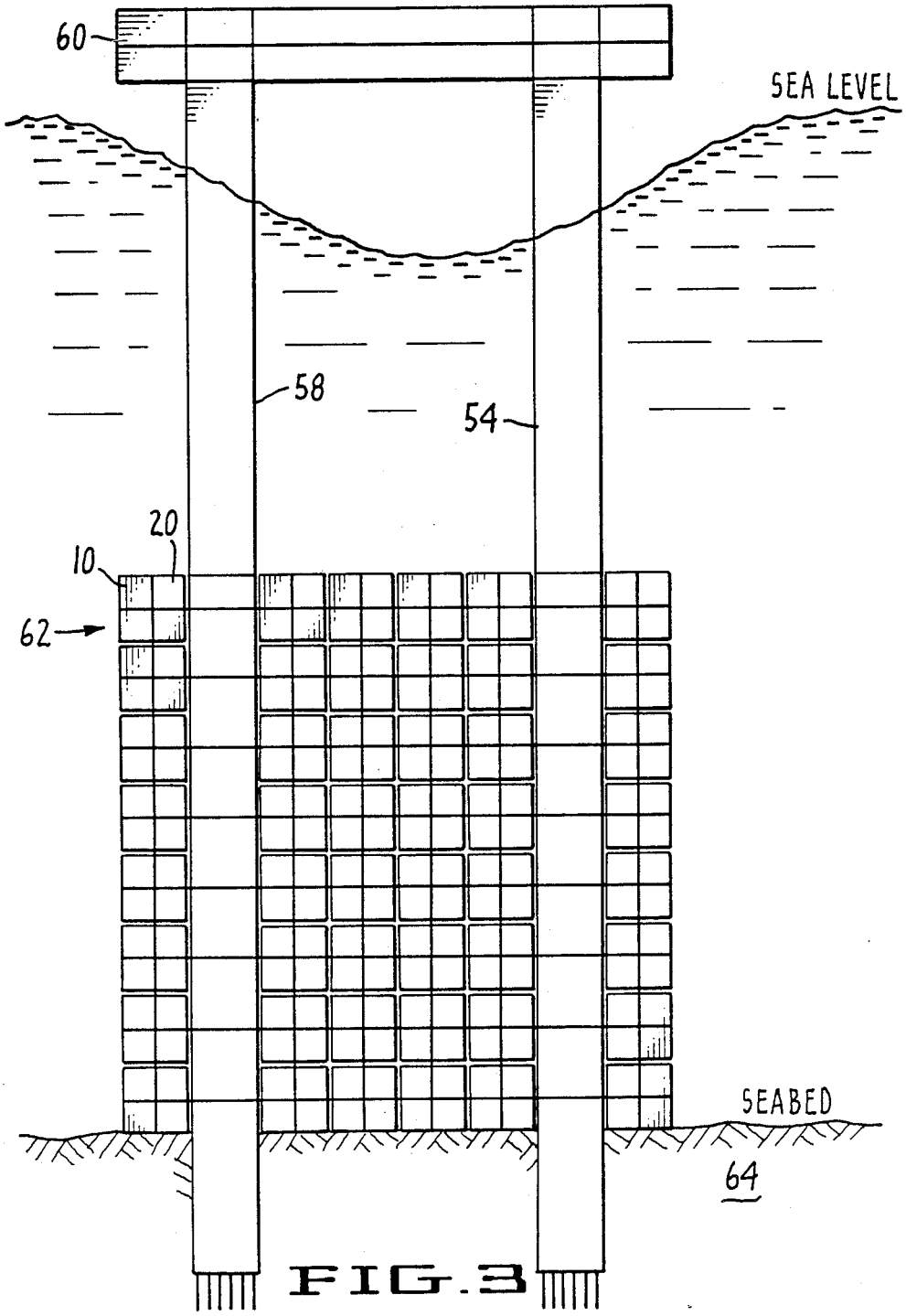
FIG. 3 is an elevational view of a petroleum drilling platform and an undersea tank constructed in accordance with the present invention.

Referring to FIG. 3, an elevation of the storage tank constructed in conjunction with an oil drilling platform is shown. The steel piers 54 and 58 are shown extending from above the surface of the body of water where they support the drilling platform 60, down and extending through the storage tank 62, and into the seabed 64. As with FIG. 2, the double solid lines indicate the junctions between adjacent structural cells, while the single solid lines indicate the tendons through the walls of each of the cells. As can be seen from FIG. 3, the storage tank showing the vertical dimension is formed from eight layers of structural cells. This provides a storage tank, in the preferred embodiment, of a height of 480 feet, a width of 480 feet, and a depth of 480 feet.

With such a structure as in FIG. 3, certain of the cells can be used at times as ballast, while other of the cells can be used as storage for oil, water, or air.

Figure 4:
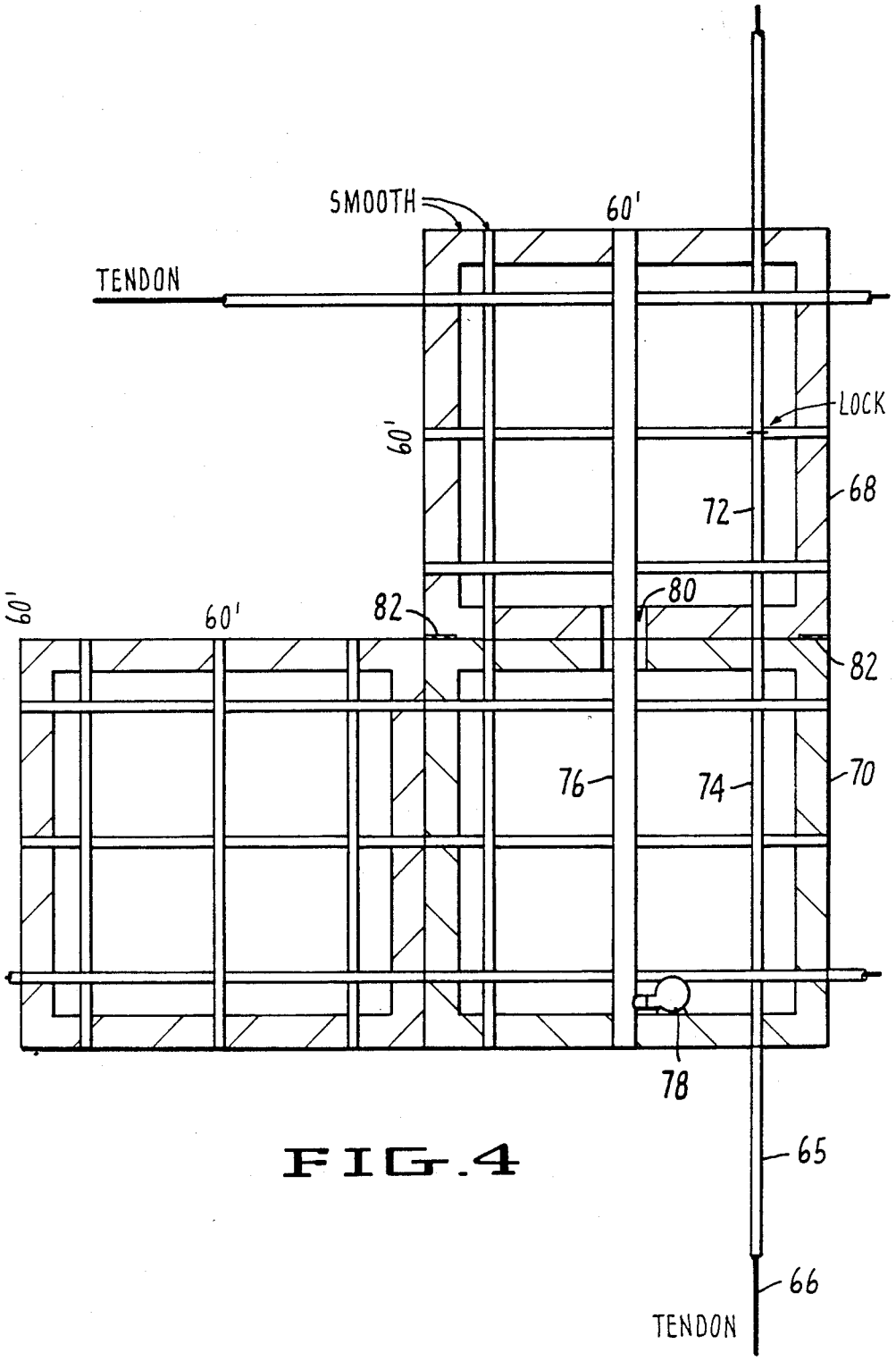
FIG. 4 illustrates three structural cells of the present invention with tendons contained through tubing that couple with each other along their length.

In the preferred embodiment to the present invention, all cells can be communicated with to selectively fill or empty each of the cells. Referring to FIG. 4, the intercommunication of each of the structural cells, and the routing of the tendons through the walls of the cells, will be described in greater detail. FIG. 4 illustrates the use of tubing 65 or piping which are positioned in the walls of each of the structural cells. The positions of the tubing in any particular wall is selected so that when the cell in which the wall is located is positioned adjacent another cell, the tubing in that particular wall will come into registration with a corresponding tubing in the corresponding wall of the adjacent cell.

Thus, a tendon, for example 66, can pass via the tubing through each of the walls of the adjacent cells, for example cells 68 and 70, and tubing portions 72 and 74, respectively, or the tendons can be passed through preformed holes.

Pipes for water or crude oil are extended through vertical columns of the structural cells. A pump at the bottom of the column provides the motive force for moving liquid into or out of each of the cells. In one embodiment to the present invention, the piping for passing liquid extends between adjacent cells by way of ports which have a diameter larger than the pipe. Thus, liquid in a particular cell can flow to the next cell below through the ports. In FIG. 4, liquid is drawn out of the cells through the pipe, e.g., 76, and to the top of the column. Pump 78 pumps liquid from the bottommost cell into pipe 76. Liquid in the cells above the bottommost cells flow through the ports 80 and into the bottommost cell. When such an arrangement is used, the outer periphery of adjoining walls for each cell are bonded together to form a fluid-tight cell. Thus, even though a port 80 has been opened between adjacent cells, the presence of the bonded outer periphery 82 of adjoining cells prevents liquid from being expelled from between the adjacent cells.

In one embodiment to the present invention, each stem of the liquid transporting pipes is threaded and connected at the joint of the cells. The oil and water pipes can also be disposed at the center of the square surfaces of the cubes, or at other points. Further, the bonding of the wall of the cubes at the outer periphery thereof can be performed by way of epoxy concrete. The tremie technique can be used to control water tightness completely.

In practice, the cells are formed individually and assembled into a structure either on land or at the drilling site. The cells can be placed floating in the water and transported out to the site. There the entire structure can be assembled. For implantation, the placement is controlled by filling certain interconnected cells with water. The assembly can also be relocated when it is desired to change location of the structure by pumping liquid out of the structure.

The basic cell can be fashioned into megastructures such as iceberg fences, iceberg fenders, atolls, flat floating cellular platforms for supporting airports, cities, nuclear plants, and the like, and artificial lagoons or toys. The toys can be of a type similar to erector sets and constructed of wood or plastic with a small number of holes to thread the wire tendons through and to consolidate any shape or structure. Such structures can include bridges, vessels, and other models.

Prestressing/posttensioning strengthens the nuclear concrete intrinsically and extrinsically. Water pressure applied when the cell is submerged also provides posttensioning to the cell. The cells are thus made water proof more easily. The compressive strength of concrete increases by 1,000 psi per 500 feet of depth. A solid concrete piece at 3,000 feet depth is completely unbreakable in compression under hydrostatic or triaxial pressure. The triaxial pressures do not have to be equal in each dimension. For hollow concrete elements, the prestressing force needed increases to 600 feet, then decreases to zero below 3,000 feet.

There is a fundamental difference between posttensioning in two dimensions (biaxial) and posttensioning in three dimensions (triaxial), as is used in the structures of this invention.

One easy way to apply three-way prestressing is by immersion deep into sea water. Another is through the use of expansive cement and properly placed reinforcements.

In this invention, the three-way dimensional prestressing is applied by tendons similar to those in the other two dimensions. At great depth, advantage may be taken of the water hydrostatic pressure.

Under triaxial pressure or prestressing, an element of concrete acquires fine tensile properties and behaves as if it could resist tension and higher compressive strength.

If $f_c$ is the allowable unrestrained compressive stress,
$p_M$=maximum principal stress
$p_m$=minimum principal stress
$x=p_M/f_c$
$y=p_m/f_c$
then the concrete is stable if:

$$y \text{ is greater than } \frac{\pm\sqrt{x^3}-1}{12}$$

If the concrete element is placed in a biaxial or triaxial tension field, it behaves as under simple tension. In accordance with the present invention, the above relationship permits posttensioning in the third dimension to be easily determined. Thus posttensioning in the third dimension becomes possible by becoming thus calculable. Also the total pressure over a side area of the cells is transmitted by mullions to girders of the cells.

In the cubic toys, each cube is held by 12 wires not necessarily under tension or by rubber bands.

It is to be understood that in accordance with the present invention, the amount of compressive forces supplied by the tendons can be selected so that a part of the total force requires to stabilize the structure and so that the water pressure supplied by the surrounding water can supply the remainder of the forces.

Figure 5:
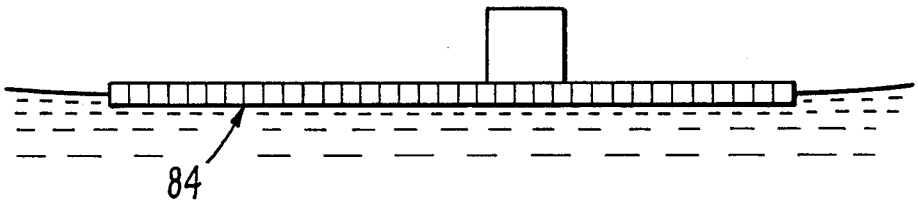
FIG. 5 illustrates the structural cells of the present invention joined to form a floating platform.

Referring to FIG. 5, a floating platform 84 is shown. Here, the structural cells are formed into a planar layer, with posttensioning in the orthogonal directions within the planar layer. As such, a floating platform is formed which resists buckling and deformation by the changing surface characteristics.

Figure 6:
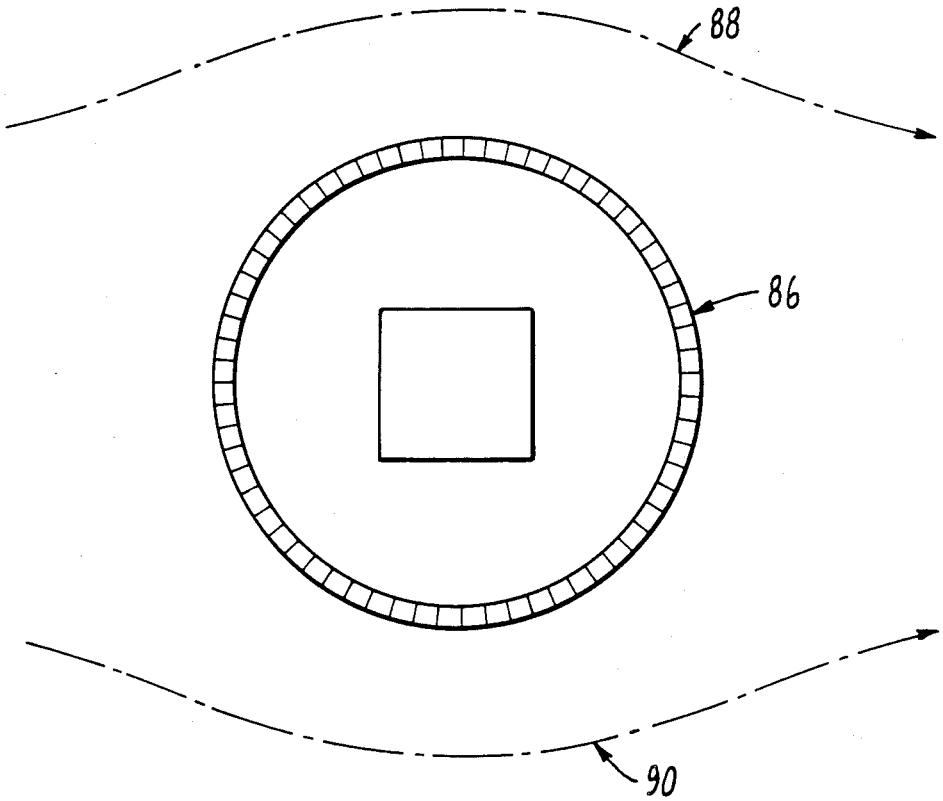
FIG. 6 illustrates the structural cells of the present invention joined to form an atoll.

Referring to FIG. 6, an atoll 86 is shown. The atoll deflects currents 88 and 90 within the body of water. The cells of the atoll 86 are partially filled with water so that the atoll is partially submerged. In turn, the atoll 86 provides a calm internal body of water in comparison to the external body of water.

Figure 7:
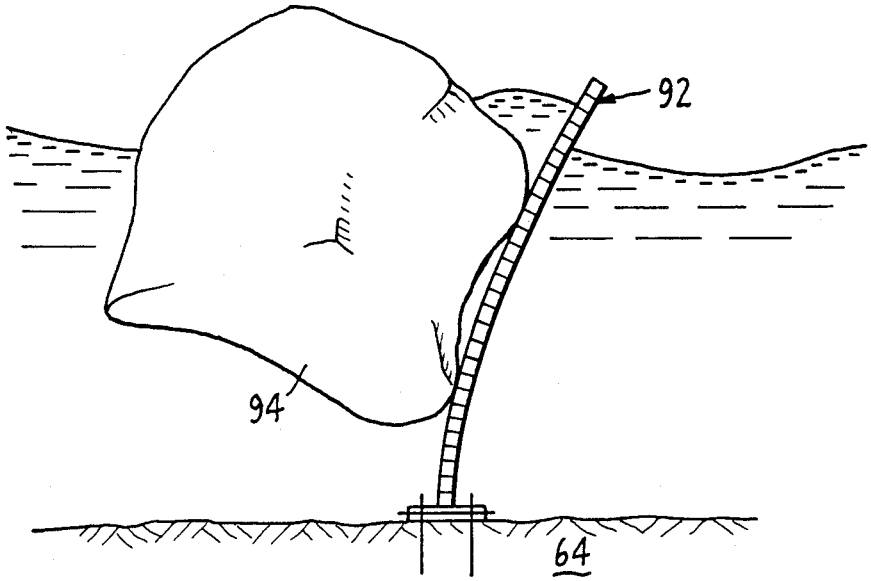
FIG. 7 illustrates the structural cells of the present invention which are joined to form a fence anchored to the bottom of a body of water for deflecting floating objects, such as icebergs.

FIG. 7 illustrates an iceberg fence constructed from cells of the present invention. The iceberg fence if formed from a planar layer of the structural cells. One edge of the layer is anchored in the seabed 64. Due to the resilience of the structure provided by the posttensioning, the iceberg 94 is permitted to deform the planar layer 92 as opposed to destroying it.

Figure 8:
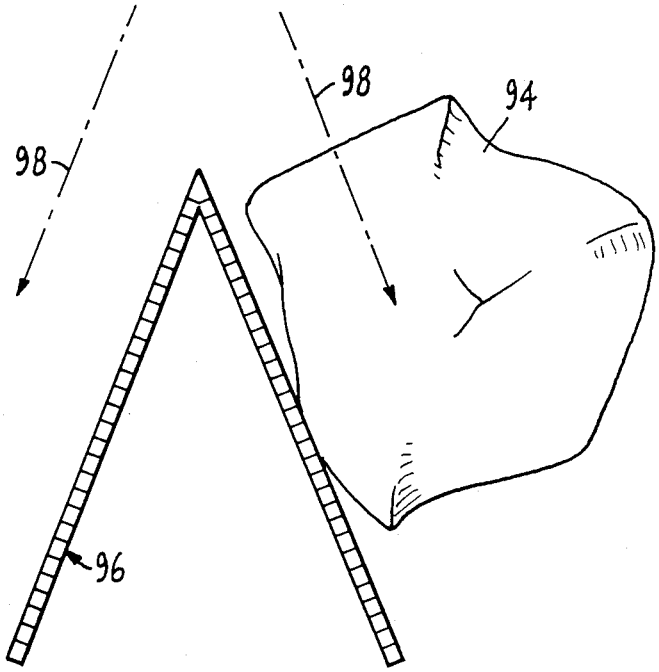
FIG. 8 shows a top view of the structural cells of the present invention joined together to form a fender for deflecting floating objects, such as icebergs.

Finally, referring to FIG. 8, an iceberg fender 96 is illustrated. The fender is formed by forming two planar layers of the structural cells and joining the layers at a common edge. The layers are angled with respect to one another so that a "V" is formed. The "V" structure is turned on its side and faced into the current 98 so as to create a wedge which deflects the current to either side of the fender 96. As such, iceberg 94 will be deflected in like manner.

The terms and expressions which have been employed here are used as terms of description and not as limitations, and there is no intention, in the use of such terms and expressions, of excluding equivalents of features shown and described, or portions thereof, it being recognized that various modifications are possible within the scope of the invention claimed.

I claim:

1. A structure comprising a plurality of substantially similar concrete cubes, each having walls of predetermined thickness which enclose a hollow interior so that each cube is floatable in water when the hollow interior is filled with air, wherein the cubes are juxtaposed to one another so that each cube has a plurality of wall each of which is positioned in a different plane, and so that for a particular plane there is a corresponding wall of an adjacent cube positioned therein;

means for maintaining the walls of adjacent cubes in contact with each other and for posttensioning the walls, including, for walls lying in a common plane, a common plurality of tendons positioned to be parallel to the common plane and extending through said walls lying in said common plane, wherein said common plurality of tendons includes a first plurality of tendons and a second plurality of tendons positioned at approximate right angles to said first plurality of tendons, and further wherein said common plurality of tendons are placed under predetermined amounts of tension to posttension the walls in the common plane in two dimensions and further wherein the posttensioning provided to walls of the cubes which are positioned in planes which are at approximate right angles to said common plane collectively posttension in a third dimension, each of said walls lying in said common plane; and means communicating with each cube for controllably filling liquid into or evacuating liquid from the cube so as to modify the buoyancy of the concrete structure.

2. The apparatus of claim 1, wherein some of the cubes are filled with liquid so that the structure sinks in water to a selected depth so that at least some of the cubes are submerged in the water and said water exerts a posttensioning force against the submerged cubes.

3. The apparatus of claim 2, wherein the plurality of cubes are positioned adjacent one another so that a structure at least two cubes thick, two cubes high and two cubes wide is provided and the common pluralities of tendons extend through all walls of the cubes having walls which occupy common planes, wherein said tendons are posttensioned to apply posttensioning forces to the structure in three orthogonal dimensions.

4. The apparatus of claim 2 wherein the maintaining means further comprise means positioned about a periphery of facing walls of juxtaposed cubes for providing a liquid tight bond between the periphery of the facing walls.

5. The apparatus of claim 2 wherein the plurality of cubes are positioned in a planar layer.

6. The apparatus of claim 5 wherein the hollow interior of each cube is filled with air so as to form a platform which floats in a body of water.

7. The apparatus of claim 5 wherein some of the cubes in the planar layer are partially filled with liquid and the planar layer is anchored at one edge to the floor of a body of water so as to form a resilient structure for deflecting objects.

8. The apparatus of claim 5 wherein opposite edges of the planar layer of cubes are joined to form a cylindrical structure.

9. The apparatus of claim 8, wherein the structure is positioned in a body of water and some of the cubes in the planar layer are filled with liquid so that said cylindrical structure forms an artificial reef, wherein the cylindrical structure is partially submerged.

10. The apparatus of claim 3, wherein said structure is filled with liquid and submerged in a body of water to operate as a base or tank for an oil drilling platform.

11. The apparatus of claim 5, further including a second planar layer of cubes which is joined at one edge to an edge of the first planar layer, wherein the first and second planar layers form a "V" shaped structure, and further wherein said "V" shaped structure is positioned on its side in a body of water so that the first and second planar layers extend into the body of water, said body of water having a current so that said "V" shaped structure forms a wedge separating the current.

12. The apparatus of claim 1, wherein the predetermined amounts of tension under which each of the common pluralities of tendons is placed is determined in accordance with the relationship:

$p_M$=maximum principal stress;

$p_m$=minimum principal stress;

$x=p_M/f_c$;

$y=p_m/f_c$;

whereby y is greater than $(\sqrt{x^3}-1)/12$ and $f_c$ is the allowable unrestrained compressive stress.

13. A structure comprising a plurality of substantially similar concrete right-angled parallelepipeds, each having walls of predetermined thickness which enclose a hollow interior so that each right-angled parallelepiped is floatable in water when the hollow interior is filled with air, wherein the right-angled parallelepipeds are juxtaposed to one another so that each right-angled parallelepiped has a plurality of walls each of which is positioned in a different plane, and so that for a particular plane there is a corresponding wall of an adjacent right-angled parallelepiped positioned therein;

means for maintaining the walls of adjacent right-angled parallelepipeds in contact with each other and for positioning the walls, including, for walls lying in a common plane, a common plurality of tendons positioned to be parallel to the common plane and extending through said walls lying in said common plane, wherein said common plurality of tendons includes a first plurality of tendons and a second plurality of tendons positioned at approximate right angles to said first plurality of tendons, and further wherein said common plurality of tendons are placed under predetermined amounts of tension to posttension the walls in the common plane in two dimensions and further wherein the posttensioning provided to walls of the rightangled parallelepipeds which are positioned in planes which are at approximate right angles to said common plane collectively posttension in a third dimension, each of said walls lying in said common plane; and means communicating with each rightangled parallelepiped for controllably filling liquid into or evacuating liquid from the cube so as to modify the buoyancy of the concrete structure.

* * * * *

UNITED STATES PATENT AND TRADEMARK OFFICE

CERTIFICATE OF CORRECTION

PATENT NO. : 4,884,918
DATED : December 5, 1989
INVENTOR(S) : Paul Gulbenkian

It is certified that error appears in the above-identified patent and that said Letters Patent is hereby corrected as shown below:

Column 10,
Line 12, "cube" should read -- Right-Angled Parallele Piped --

Signed and Sealed this

Thirtieth Day of April, 2002

*Attest:*

*Attesting Officer*

JAMES E. ROGAN
*Director of the United States Patent and Trademark Office*